US012329263B1

(12) United States Patent
Zhou

(10) Patent No.: US 12,329,263 B1
(45) Date of Patent: Jun. 17, 2025

(54) ROLL-ON PACKAGING BOTTLE

(71) Applicant: PPK (SHANGHAI) PACKAGING CO., LTD., Shanghai (CN)

(72) Inventor: Helin Zhou, Shanghai (CN)

(73) Assignee: PPK (SHANGHAI) PACKAGING CO., LTD., Shanghai (CN)

( * ) Notice: Subject to any disclaimer, the term of this patent is extended or adjusted under 35 U.S.C. 154(b) by 0 days.

(21) Appl. No.: 18/961,346

(22) Filed: Nov. 26, 2024

Related U.S. Application Data

(63) Continuation of application No. PCT/CN2023/118942, filed on Sep. 15, 2023.

(51) Int. Cl.
*A45D 34/04* (2006.01)
*B65D 77/04* (2006.01)

(52) U.S. Cl.
CPC ..... *A45D 34/041* (2013.01); *B65D 77/0486* (2013.01); *A45D 2200/05* (2013.01)

(58) Field of Classification Search
CPC ..... A45D 34/041; A45D 40/261; B65D 41/0442; B65D 41/0464
USPC ..... 401/209
See application file for complete search history.

(56) References Cited

U.S. PATENT DOCUMENTS 7,618,208 B2 * 11/2009 Baines ..... A45D 40/261 401/213
8,221,018 B2 * 7/2012 Steinhagen ..... A45D 34/041 401/209

FOREIGN PATENT DOCUMENTS

| | | | | |
|---|---|---|---|---|
| CN | 101022747 | A | 8/2007 | |
| CN | 202379232 | U | 8/2012 | |
| CN | 204191853 | U | 3/2015 | |
| CN | 204519716 | U | 8/2015 | |
| CN | 210383022 | U | 4/2020 | |
| CN | 112273837 | A | 1/2021 | |
| CN | 113002971 | A | 6/2021 | |
| CN | 213678005 | U | 7/2021 | |
| CN | 213696054 | U | 7/2021 | |
| CN | 219042598 | U | 5/2023 | |
| DE | 29914452 | U1 * | 12/1999 | ..... A45D 34/041 |
| GB | 1515078 | A | 6/1978 | |
| JP | 2018090261 | A * | 6/2018 | |

* cited by examiner

*Primary Examiner* — Jennifer C Chiang

(74) *Attorney, Agent, or Firm* — Bayramoglu Law Offices LLC

(57) ABSTRACT

A liquid cosmetic container is provided. A roll-on packaging bottle includes an outer bottle, a cap, a roller ball, a connector, and an inner bottle, where the roller ball is provided in the connector; an inner ring of the cap is provided with a limit member; the connector includes a connecting seat, a limit ring, and a roller ball cavity; a diameter of an inner cavity of a barrel matches with an outer diameter of the roller ball; the roller ball is provided in the roller ball cavity; a liquid outlet and an annular profile attached to an outer surface of the roller ball are provided on the connecting seat; and an opening of the limit ring is collapsed inward along the outer surface of the roller ball by a certain distance.

20 Claims, 8 Drawing Sheets

ROLL-ON PACKAGING BOTTLE

CROSS-REFERENCE TO THE RELATED APPLICATIONS

This application is a continuation application of International Application No. PCT/CN2023/118942, filed on Sep. 15, 2023, the entire contents of which are incorporated herein by reference.

TECHNICAL FIELD

The present disclosure relates to the field of cosmetics, and in particular to a liquid cosmetic container.

BACKGROUND

For most existing deodorant structures, a liquid deodorant is provided in the container. A roller ball cavity and a liquid outlet are formed in a top of the bottle. An application head composed of a roller ball is provided on the liquid outlet. The bottle is inverted in use. In the rolling of the application head, the liquid deodorant is brought out, and applied to the body. This is similar to the ball-point pen in principle. The whole bottle is made of plastic. After the liquid deodorant is used up, the whole bottle is abandoned. In a non-use state, the cap is screwed to the bottle through a thread. With a pre-tightening force of the thread, the knockout ring in the cap squeezes the roller ball, such that the roller ball is fixed to obstruct the liquid outlet, thereby preventing leakage of the liquid deodorant.

The existing technology has the following defects: In view of environmental protection, when a replaceable liner is used in the container, the reliability of the original simple press sealing manner is reduced significantly with the elapse of time. Meanwhile, a detachable press connector is provided for the replaceable liner. The connector is connected to the outer bottle through a thread. However, it is undesirable to provide a threaded structure for the cap to connect the outer bottle. The cap is connected to the outer bottle through a snap-on structure in most cases, such that the knockout ring has the insufficient pressing force for the roller ball. This further reduces the sealing reliability in the non-use state to cause troubles to the consumers in use. Therefore, it is desirable to provide a novel liquid outlet structure, with a more reliable sealing form, thereby improving the use experience of the consumers for the replaceable container.

SUMMARY

A technical problem to be solved by the present disclosure is to provide a roll-on packaging bottle. By additionally providing the limit ring having the opening collapsed inward, and pressing the limit ring through the limit member on the cap, the roll-on packaging bottle improves the sealing reliability when the roller ball contacts the sealing surface in the non-use state.

The present disclosure is realized as follows: a roll-on packaging bottle includes an outer bottle, a cap, a roller ball, a connector, and an inner bottle, where both the outer bottle and the inner bottle are a container with an opening; the inner bottle is provided in the outer bottle; the connector is connected to the opening of the outer bottle and configured to fix the inner bottle; the roller ball is provided in the connector; an inner ring of the cap is provided with a limit member; the connector includes a connecting seat and a limit ring; the limit ring is connected to the connecting seat to form a roller ball cavity; the connector is provided on the outer bottle through the connecting seat; the limit ring is a barrel coaxial with the connecting seat; a diameter of an inner cavity of the barrel matches with an outer diameter of the roller ball; and the roller ball is provided in the roller ball cavity;

a liquid outlet communicating with the inner bottle is formed in the connecting seat at a side of the roller ball cavity adjacent to the outer bottle; and a circle of annular profile attached to an outer surface of the roller ball is provided at an upper edge of the liquid outlet;

an opening of the limit ring at a side of the roller ball cavity away from the outer bottle is collapsed inward along the outer surface of the roller ball by a certain distance, such that a diameter of the opening of the limit ring is slightly less than the diameter of the roller ball; and the limit ring is made of a material having certain elasticity; and in a non-use state, the cap covers the connector, the limit member is in interference fit with the limit ring, and sealing fit is formed at least between the roller ball and the limit ring, and between the roller ball and the annular profile.

A knockout member is further provided on an inner wall of the cap; the knockout member is a cylindrical barrel; the cylindrical barrel is provided on the inner wall of the cap; and in the non-use state, a knockout portion of the knockout member directly or indirectly squeezes and fixes the roller ball, such that the sealing fit is formed between the roller ball and the annular profile.

The limit member is a cylindrical barrel; the cylindrical barrel is provided in the cap; and in the non-use state, the cylindrical barrel is in interference fit with an outer wall of the limit ring.

The limit member and the cap are integrally formed into a whole.

The cylindrical barrel is detachably provided on the knockout member.

A bottom of a region of the cylindrical barrel matching with the outer wall of the limit ring extends horizontally outward and then bends to form a supporting groove; and an outer wall of the supporting groove is attached to the inner wall of the cap.

A side of the cylindrical barrel away from the outer bottle is provided with a knockout plate; a first movable receiving groove matching with the knockout member is formed in a top surface of the knockout plate; and in the non-use state, the knockout portion of the knockout member indirectly squeezes and fixes the roller ball through a bottom surface of the knockout plate.

A squeezing member is detachably provided in the cap; a lower end surface of the squeezing member is a concave spherical surface matching with a profile of the outer surface of the roller ball; an insertion groove is formed in an upper end surface of the squeezing member; and in the non-use state, the knockout portion of the knockout member indirectly squeezes and fixes the roller ball through the concave spherical surface.

A contact surface where a lower edge of the concave spherical surface contacts an upper edge of the limit ring is a truncated cone surface; and an aperture of a side of the truncated cone surface away from the outer bottle is greater than an aperture of a side of the truncated cone surface close to the outer bottle.

An elastic supporting structure is provided on the connecting seat; the limit member is a cylindrical barrel; the cylindrical barrel is provided in the cap; and in the non-use state, the elastic supporting structure pushes the roller ball to be pressed toward the limit ring, such that the sealing fit is formed between the roller ball and the limit ring, and the cylindrical barrel is in interference fit with an outer wall of the limit ring; and the elastic supporting structure includes a plurality of fan-shaped elastic pieces; the plurality of fan-shaped elastic pieces are arranged on an inner ring of the liquid outlet in an annular array; a clearance is reserved between two adjacent ones of the fan-shaped elastic pieces; in the non-use state, the fan-shaped elastic pieces push the roller ball to be pressed toward the limit ring; and in use, the roller ball under a pressure pushes the fan-shaped elastic pieces to expand.

The elastic supporting structure includes a plurality of elastic restoration members arranged centrosymmetrically between the limit ring and the annular profile.

The elastic supporting structure includes an elastic piece, a supporting piece, and a valve trim; a moving clearance is provided between the elastic piece and the supporting piece; a recessed region is provided at an axis of the elastic piece; the supporting piece is provided with a piston cavity matching with a moving distance of the recessed region; through holes matching with each other are respectively formed in the recessed region and the piston cavity; the valve trim includes one end matching with the through hole in the recessed region through an open valve cover, and the other end matching with the through hole in the piston cavity through a sealed valve cover; in the non-use state, the elastic piece pushes the roller ball to be pressed toward the limit ring, such that the sealed valve cover seals the through hole in the piston cavity; and in use, the roller ball under a pressure pushes the valve trim to move toward the bottle, such that both the through hole in the recessed region and the through hole in the piston cavity are open.

An upper edge of the limit ring is provided with a sealing ring; in the non-use state, the sealing ring contacts the roller ball in a sealing manner; and the sealing ring is made of a thermoplastic polyurethane (TPU) material.

The limit ring includes a fixed ring and a roller ball barrel; the fixed ring is integrally formed on the connecting seat; a second movable receiving groove matching with the fixed ring is formed in a bottom of the roller ball barrel; and an opening in a top of the roller ball barrel matches with the outer surface of the roller ball.

The limit ring includes a fixed ring and a roller ball barrel; the fixed ring is integrally formed with the supporting piece; and the roller ball barrel is integrally formed with the elastic piece.

According to the roll-on packaging bottle provided by the present disclosure, with the replaceable inner bottle, the service life of the container is prolonged significantly. By additionally providing the limit ring having the opening collapsed inward, and pressing the limit ring through the limit member on the cap, the present disclosure improves the sealing reliability when the roller ball contacts the sealing surface in the non-use state, and improves the use experience of the consumers.

In the figures: 1: outer bottle, 2: cap, 3: roller ball, 4: connector, 5: inner bottle, 6: limit member, 7: squeezing member, 21: knockout member, 41: connecting seat, 42: roller ball cavity, 43: limit ring, 44: liquid outlet, 45: annular profile, 46: fan-shaped elastic piece, 47: sealing ring, 48: elastic restoration member, 51: turning edge, 61: cylindrical barrel, 62: first movable receiving groove, 63: supporting groove, 64: knockout plate, 71: concave spherical surface, 72: truncated cone surface, 73: insertion groove, 411: limiting surface, 431: fixed ring, 432: roller ball barrel, 433: second movable receiving groove, 491: elastic piece, 492: supporting piece, 493: moving clearance, 494: recessed region, 495: piston cavity, 496: through hole, 497: valve trim, 498: open valve cover, and 499: sealed valve cover.

DETAILED DESCRIPTION OF THE EMBODIMENTS

The present disclosure will be described in detail below in combination with specific embodiments. It should be understood that these embodiments are only intended to describe the present disclosure, rather than to limit the scope of the present disclosure. In addition, it is to be understood that various changes and modifications can be made to the present disclosure by those skilled in the art after reading the contents of the present disclosure, and these equivalent forms also fall within the scope defined by the appended claims of the present disclosure.

EMBODIMENTS

Figure 2:
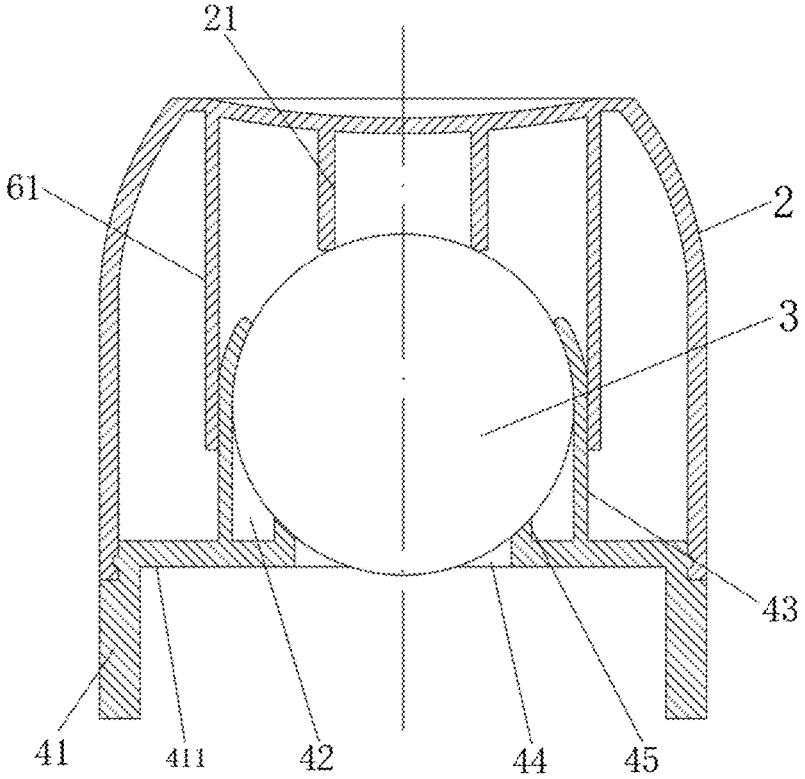
FIG. 2 is a schematic sectional view of a region above a bottle according to Embodiment 1 of the present disclosure.
Figure 3:
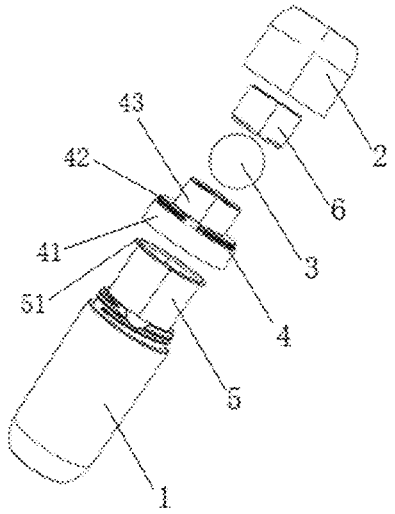
FIG. 3 is a schematic exploded view of parts according to Embodiment 2 of the present disclosure.

As shown in FIG. 2 and FIG. 3, a roll-on packaging bottle includes outer bottle 1, cap 2, roller ball 3, connector 4, and inner bottle 5. Both the outer bottle 1 and the inner bottle 5 are a container with an opening. The inner bottle 5 is provided in the outer bottle 1. The connector 4 is connected to the opening of the outer bottle 1 and configured to fix the inner bottle 5. The roller ball 3 is provided in the connector 4. An inner ring of the cap 2 is provided with limit member 6. The connector 4 includes connecting seat 41 and limit ring 43. The limit ring 43 is connected to the connecting seat 41 to form roller ball cavity 42. The connector 4 is provided on the outer bottle 1 through the connecting seat 41. The limit ring 43 is a barrel coaxial with the connecting seat 41. A diameter of an inner cavity of the barrel matches with an outer diameter of the roller ball 3. The roller ball 3 is provided in the roller ball cavity 42. In mounting, the inner bottle 5 is provided in the outer bottle 1. The connector 4 is provided on the outer bottle. The connecting seat 41 of the connector 4 presses and fixes turning edge 51 of the inner bottle 5 through limiting surface 411.

The present disclosure can further be described as follows: Liquid outlet 44 communicating with the inner bottle 5 is formed in the connecting seat 41 at a side of the roller ball cavity 42 adjacent to the outer bottle 1. A circle of annular profile 45 attached to an outer surface of the roller ball 3 is provided at an upper edge of the liquid outlet 44. An opening of the limit ring 43 at a side of the roller ball cavity 42 away from the outer bottle 1 is collapsed inward along the outer surface of the roller ball 3 by a certain distance, such that a diameter of the opening of the limit ring 43 is slightly less than the diameter of the roller ball 3, thereby keeping the roller ball 3 in the roller ball cavity 42. The limit member 6 is cylindrical barrel 61. The cylindrical barrel 61 is provided in the cap 2. In general, the diameter of the opening of the limit ring 43 is collapsed gradually inward to 80-95% of the diameter of the roller ball 3.

In a non-use state, the cap 2 covers the connector 4, and the cylindrical barrel 61 is in interference fit with an outer wall of the limit ring 43. The limit ring 43 is made of a material having certain elasticity. For example, when the polyethylene (PE) material is used, the elasticity modulus is 100-300 MPa. When the polypropylene (PP) material is used, the elasticity modulus is 0.8-2.5 GPa. After the cap 2 covers the connector, the cylindrical barrel 61 squeezes the limit ring 43 through the interference fit, such that the limit ring 43 is collapsed slightly inward, and the limit ring 43 locks the roller ball 3. Sealing fit is formed at least between the roller ball 3 and the limit ring 43, and between the roller ball 3 and the annular profile 45. In use, the cap 2 is taken down. The roll-on packaging bottle is inverted. The roller ball 3 contacts a body surface. Under a pressure toward the outer bottle 1, the roller ball is loosened and can roll freely. A liquid cosmetic in the inner bottle 5, such as a deodorant, is brought out by the roller ball 3 to the body surface.

In view of environmental protection, the replaceable inner bottle 3 in the present disclosure is made of a degradable material. The degradable material is a paper material prepared from wood fibers, bamboo fibers, chitosan fibers or poly (lactic acid) fibers.

In Embodiment 1, Embodiment 2, and Embodiment 3, knockout member 21 is further provided on an inner wall of the cap 2. The knockout member 21 is a cylindrical barrel. The cylindrical barrel is provided on the inner wall of the cap 2. In the non-use state, a knockout portion of the knockout member 21 directly or indirectly squeezes and fixes the roller ball 3, such that the sealing fit is formed between the roller ball 3 and the annular profile 45. In use, the cap 2 is taken down. The roll-on packaging bottle is inverted, such that the roller ball 3 is downward. By this time, the roller ball 3 is loosened, and can rotate freely. The liquid deodorant is brought out from the liquid outlet 44 and applied to the body.

Embodiment 1

Figure 1:
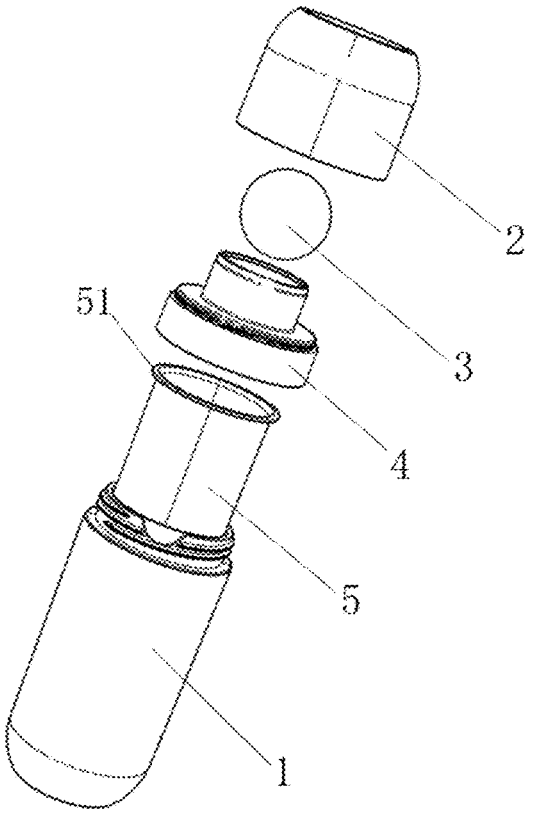
FIG. 1 is a schematic exploded view of parts in a roll-on packaging bottle according to Embodiment 1 of the present disclosure.

As shown in FIG. 1 and FIG. 2, the limit member 6 and the cap 2 are integrally formed into a whole.

Embodiment 2

Figure 4:
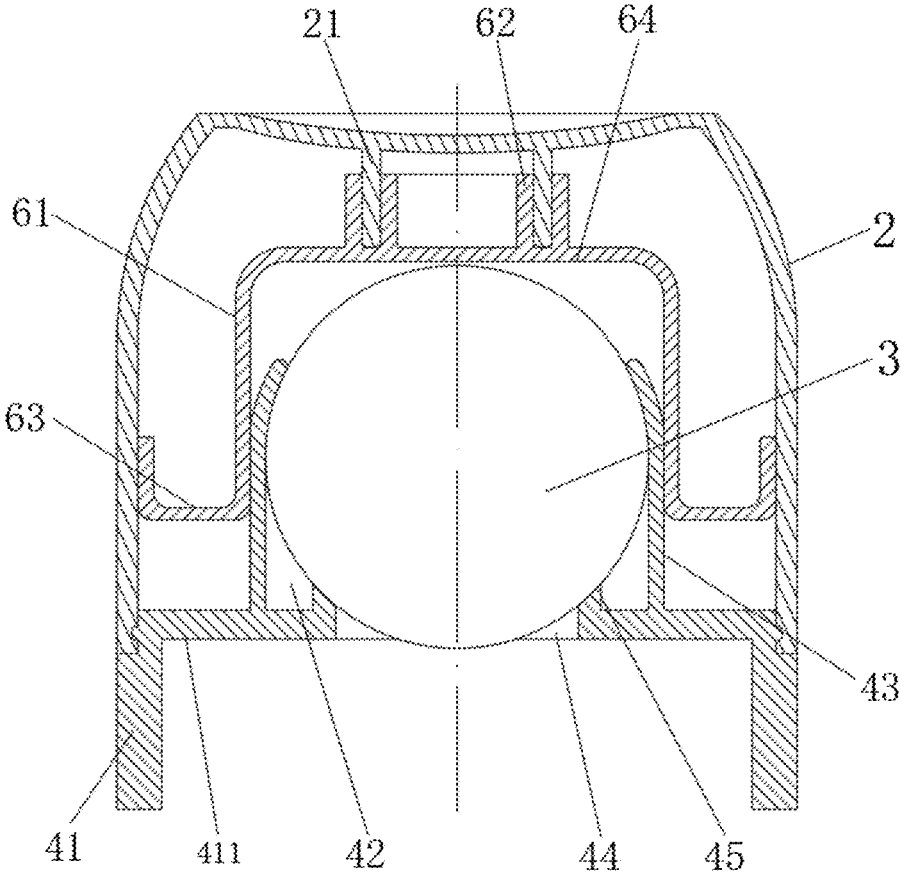
FIG. 4 is a schematic sectional view of a region above a bottle according to Embodiment 2 of the present disclosure.

As shown in FIG. 3 and FIG. 4, the cylindrical barrel 61 is detachably provided on the knockout member 21. The embodiment differs from Embodiment 1 in: A bottom of a region of the cylindrical barrel 61 matching with the outer wall of the limit ring 43 extends horizontally outward and then bends to form supporting groove 63. An outer wall of the supporting groove 63 is attached to the inner wall of the cap 2.

The embodiment can further be described as follows: A side of the cylindrical barrel 61 away from the outer bottle 1 is provided with knockout plate 64. First movable receiving groove 62 matching with the knockout member 21 is formed in a top surface of the knockout plate 64. In the non-use state, the knockout portion of the knockout member 21 indirectly squeezes and fixes the roller ball 3 through a bottom surface of the knockout plate 64. For ease of detachment and cleaning, the first movable receiving groove 62 is connected to the knockout member 21 by insertion. In the embodiment, preferably, the knockout plate 64 is a flat plate.

Embodiment 3

Figure 5:
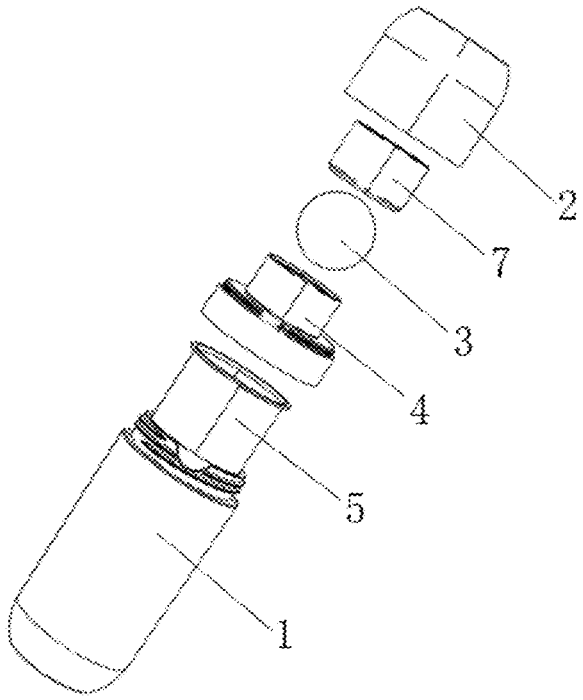
FIG. 5 is a schematic exploded view of parts according to Embodiment 3 of the present disclosure.
Figure 6:
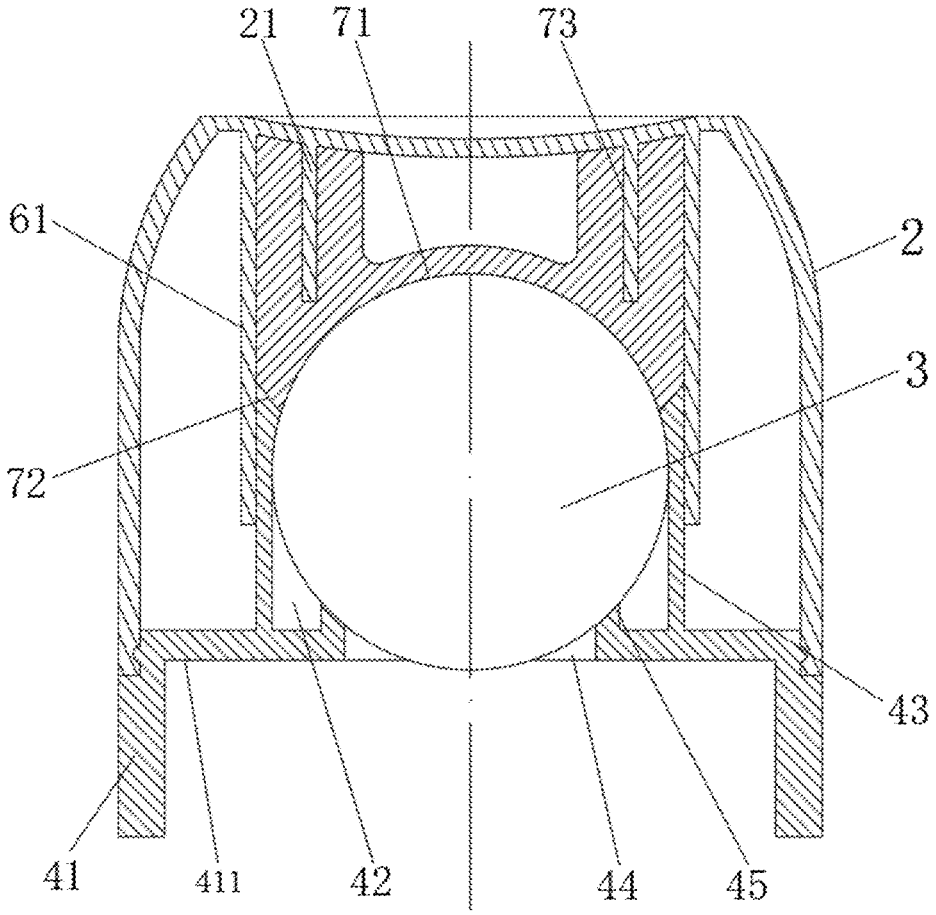
FIG. 6 is a schematic sectional view of a region above a bottle according to Embodiment 3 of the present disclosure.
Figure 7:
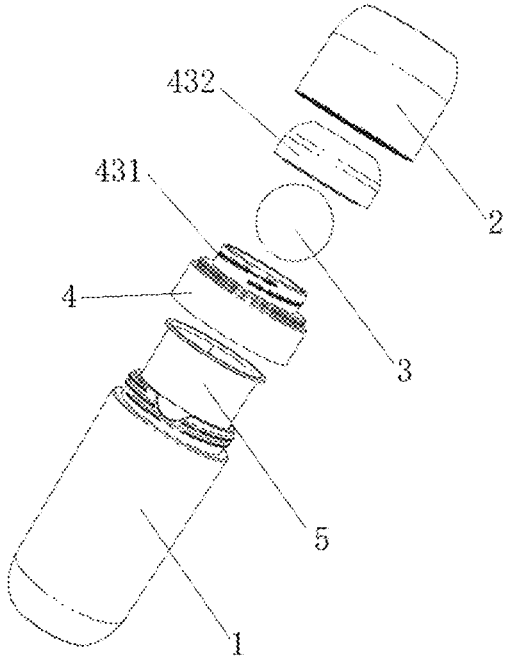
FIG. 7 is a schematic exploded view of parts according to Embodiment 4 of the present disclosure.
Figure 8:
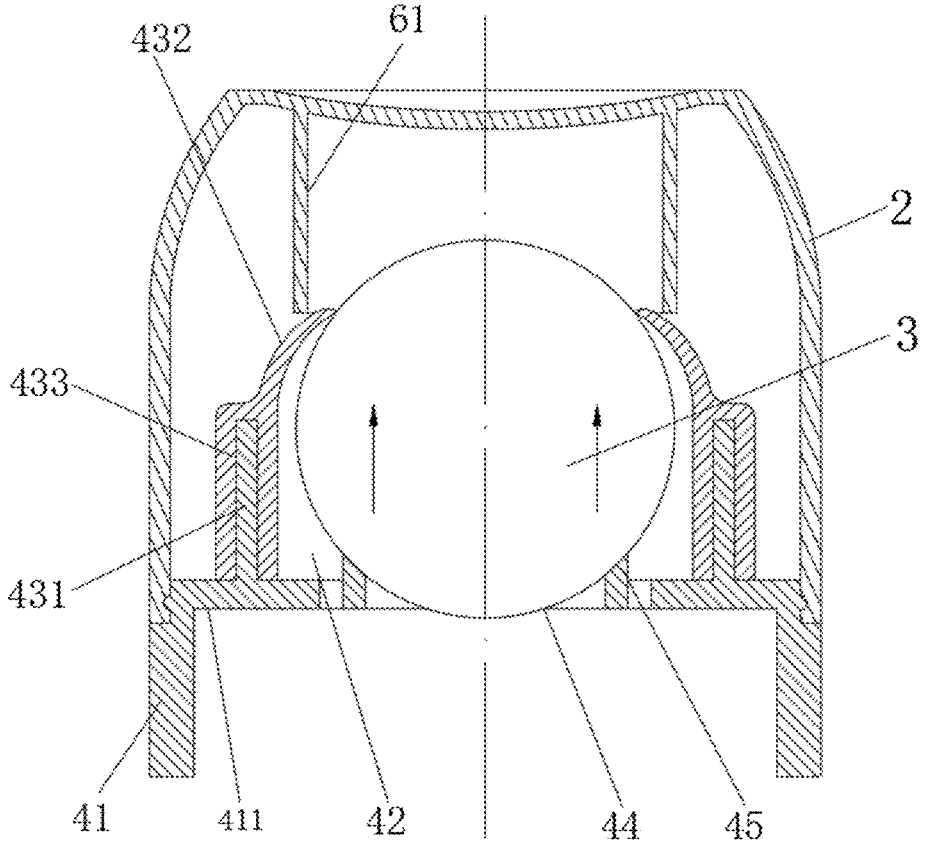
FIG. 8 is a schematic sectional view of a region above a bottle in a non-use state according to Embodiment 4 of the present disclosure.
Figure 9:
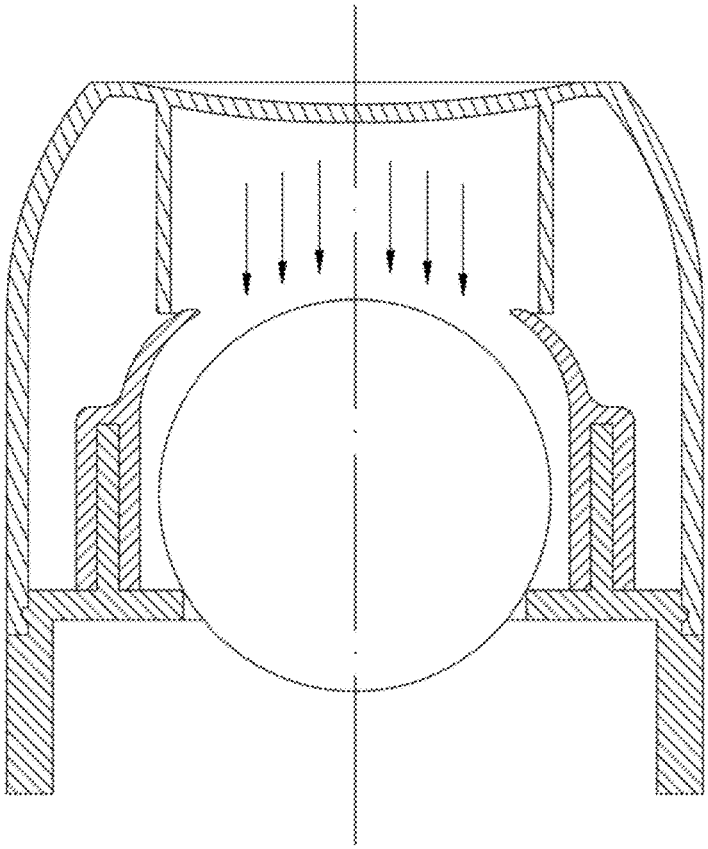
FIG. 9 is a schematic view of a state of a roller ball in a use state shown in FIG. 8.
Figure 10:
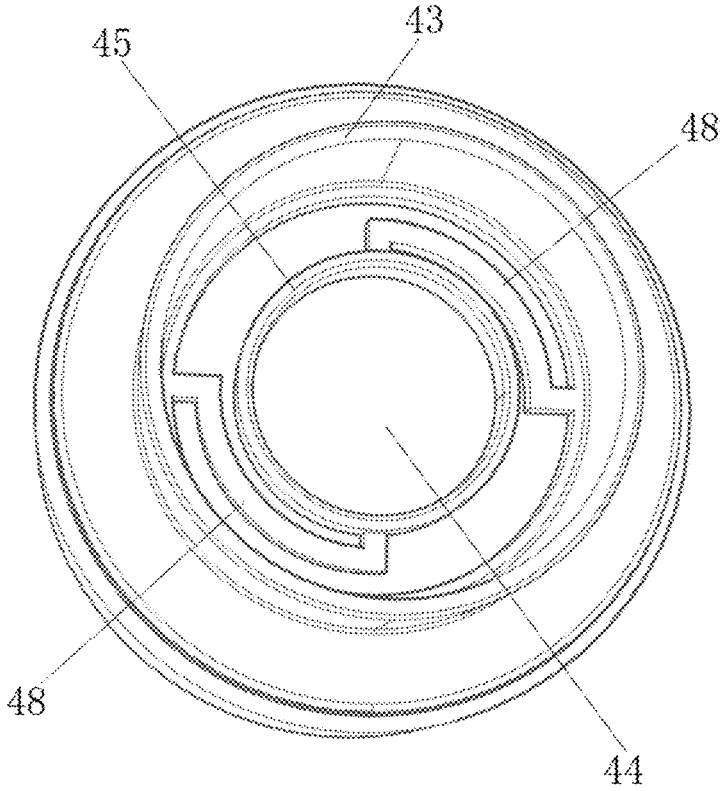
FIG. 10 is a schematic perspective view of an elastic supporting structure according to Embodiment 4 of the present disclosure.

As shown in FIG. 5 and FIG. 6, the embodiment differs from Embodiment 1 in: Squeezing member 7 is detachably provided in the cap 2. A lower end surface of the squeezing member 7 is concave spherical surface 71 matching with a profile of the outer surface of the roller ball 3. Insertion groove 73 is formed in an upper end surface of the squeezing member 7. In the non-use state, the knockout portion of the knockout member 21 indirectly squeezes and fixes the roller ball 3 through the concave spherical surface 71.

In the embodiment, in order to ensure directivity and stability in squeezing, a contact surface where a lower edge of the concave spherical surface 71 contacts an upper edge of the limit ring 43 is truncated cone surface 72. An aperture of a side of the truncated cone surface 72 away from the outer bottle 1 is greater than an aperture of a side of the truncated cone surface close to the outer bottle 1.

In Embodiment 4, Embodiment 5 and Embodiment 6, an elastic supporting structure is provided on the connecting seat 41. The limit member 6 is cylindrical barrel 61. The cylindrical barrel 61 is provided in the cap 2. In the non-use state, the elastic supporting structure pushes the roller ball 3 to be pressed toward the limit ring 43, such that the cylindrical barrel 61 is in interference fit with an outer wall of the limit ring 43 to lock the roller ball 3, and the sealing fit is formed between the roller ball 3 and the limit ring 43. In use, the roll-on packaging bottle is inverted, such that the roller ball 3 is downward. The roller ball 3 contacts the body. Under a pressure toward the bottle 1, the elastic supporting structure is pushed, such that the roller ball 3 is loosened, and can rotate freely. The liquid deodorant is flowed to the roller ball 3. With rotation of the roller ball 3, the liquid deodorant is brought out and applied to the body.

Embodiment 4

As shown in FIG. 7, FIG. 8, FIG. 9 and FIG. 10, the elastic supporting structure includes a plurality of elastic restoration members 48 arranged centrosymmetrically between the limit ring 43 and the annular profile 45. The elastic restoration members 48 each are an S-shaped torsional spring or a material between the limit ring 43 and the annular profile 45 is hollowed out to form the S-shaped elastic restoration member 48.

In the embodiment, as a further improved embodiment, for ease of detachment of the roller ball 3 for cleaning, the limit ring 43 includes fixed ring 431 and roller ball barrel 432. The fixed ring 431 is integrally formed on the connecting seat 41. Second movable receiving groove 433 matching with the fixed ring 431 is formed in a bottom of the roller ball barrel 432. An opening in a top of the roller ball barrel 432 matches with the outer surface of the roller ball 3. In general, in view of connection reliability between the fixed ring 431 and the second movable receiving groove 433, the fixed ring and the second movable receiving groove are connected through a thread. After the second movable receiving groove 433 is detached, the roller ball cavity 42 can be opened, and the roller ball 3 can be taken out.

When a split detachable structure is used, considering that a position squeezed by the cylindrical barrel 61 to the limit ring 43 may be interfered by the second movable receiving groove 433, a radian that an upper edge of the roller ball barrel 432 bends inward is large, such that the cylindrical barrel 61 directly squeezes an upper portion of the roller ball barrel 432.

Embodiment 5

Figure 11:
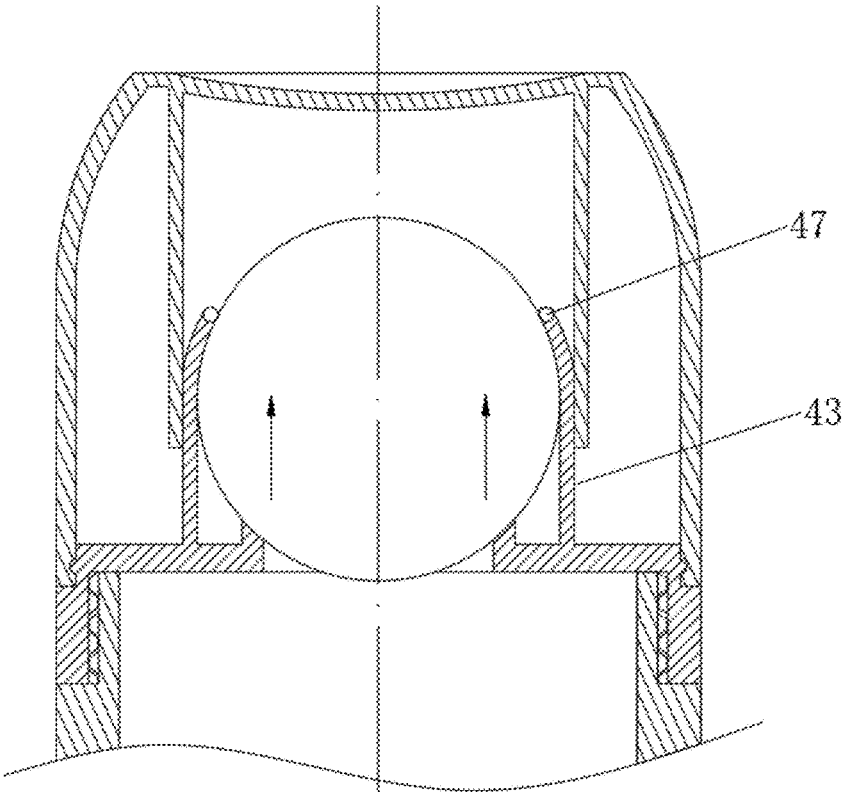
FIG. 11 is a schematic sectional view of a region above a bottle in a non-use state according to Embodiment 5 of the present disclosure.
Figure 12:
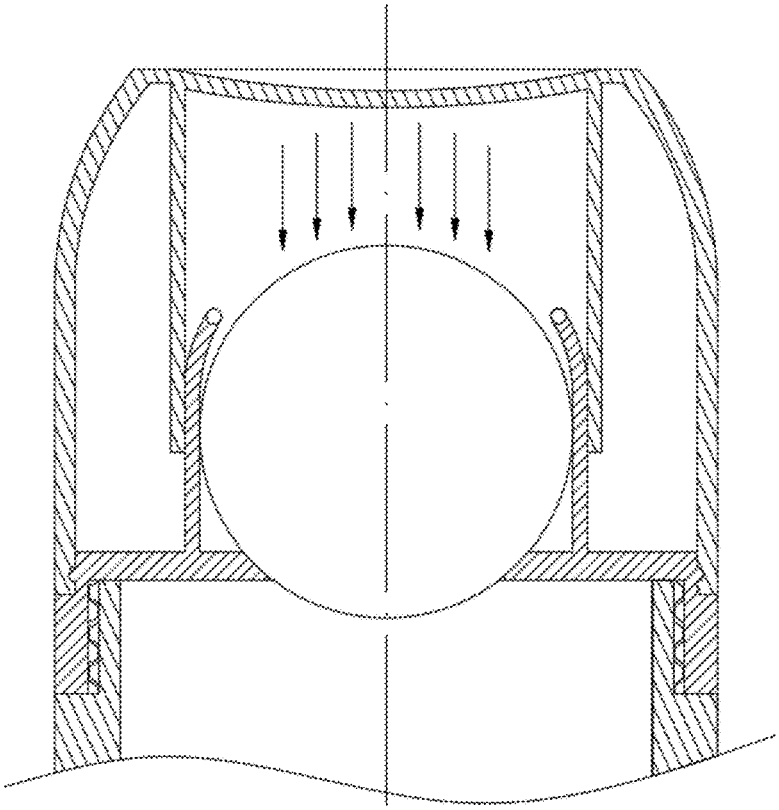
FIG. 12 is a schematic view of a state of a roller ball in a use state shown in FIG. 11.
Figure 13:
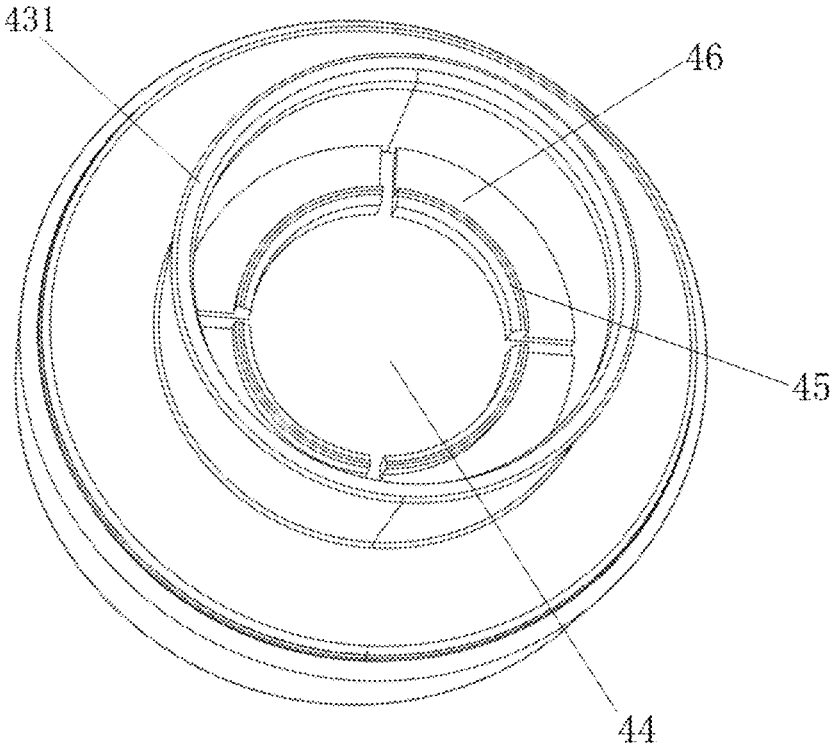
FIG. 13 is a schematic perspective view of an elastic supporting structure according to Embodiment 5 of the present disclosure.

As shown in FIG. 11, FIG. 12 and FIG. 13, Embodiment 5 differs from Embodiment 4 in: The elastic supporting structure includes a plurality of fan-shaped elastic pieces 46. The plurality of fan-shaped elastic pieces 46 are arranged on an inner ring of the liquid outlet 44 in an annular array. A clearance is reserved between two adjacent ones of the fan-shaped elastic pieces 46. In the non-use state, the fan-shaped elastic pieces 46 push the roller ball 3 to be pressed toward the limit ring 43. In use, the roller ball 3 under a pressure pushes the fan-shaped elastic pieces 46 to expand. In the embodiment, as a further improved embodiment, an upper edge of the limit ring 43 is provided with sealing ring 47. In the non-use state, the sealing ring 47 contacts the roller ball 3 in a sealing manner. The sealing ring 47 is made of a TPU material.

Embodiment 6

Figure 14:
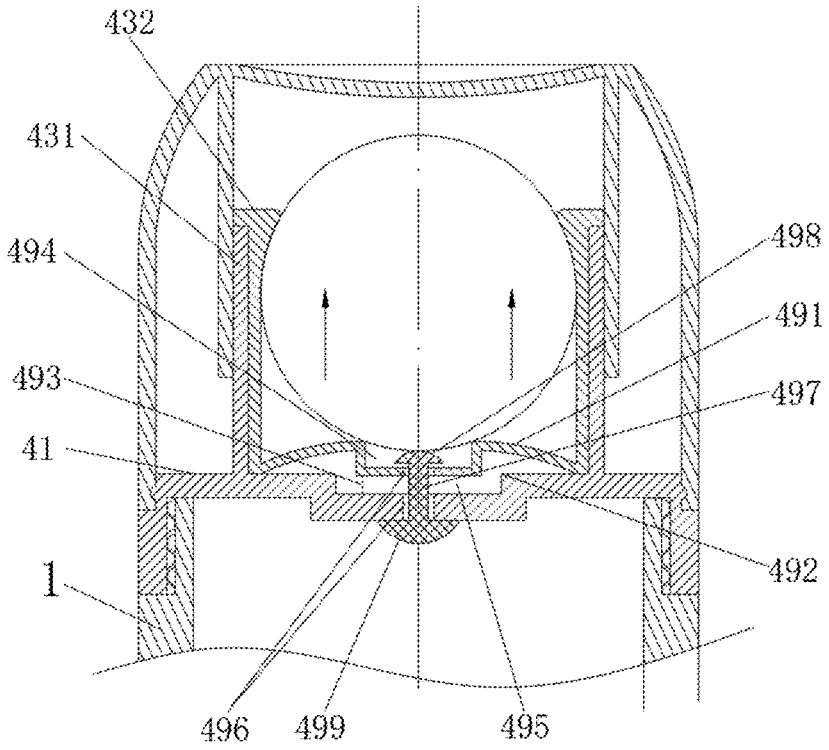
FIG. 14 is a schematic sectional view of a region above a bottle in a non-use state according to Embodiment 6 of the present disclosure.
Figure 15:
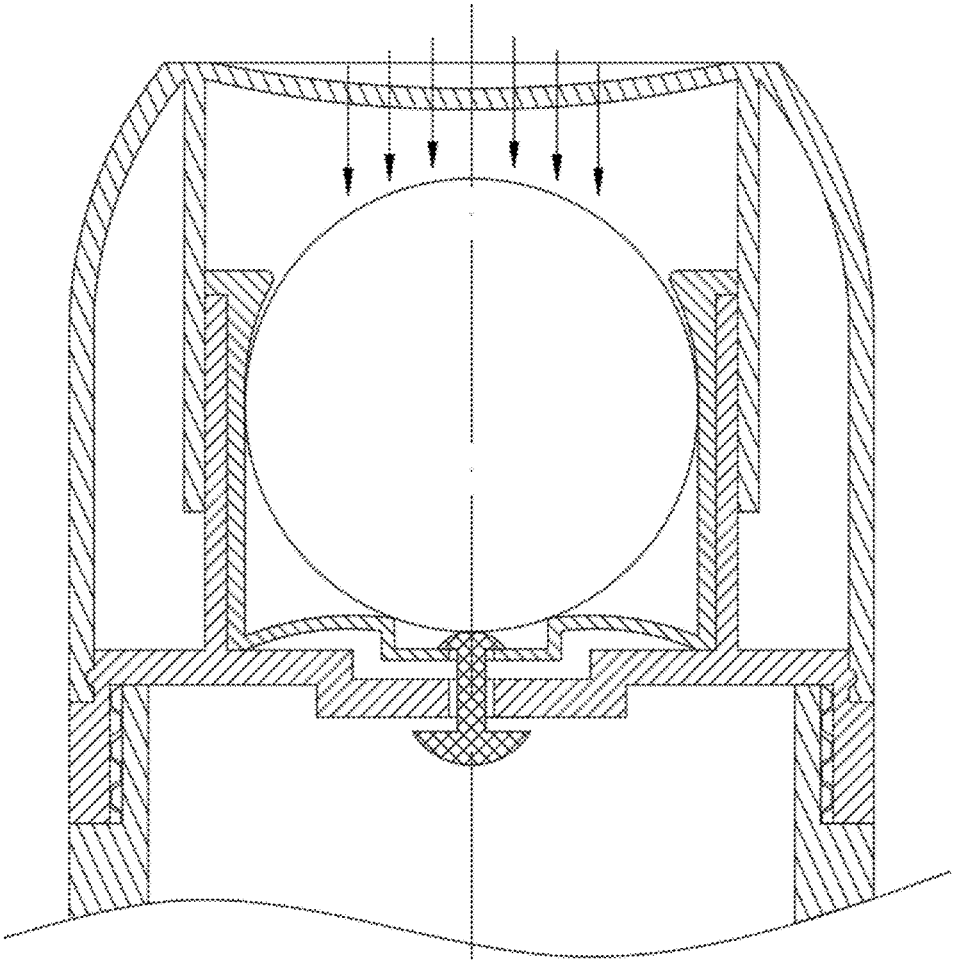
FIG. 15 is a schematic view of a state of a roller ball in a use state shown in FIG. 14.
Figure 16:
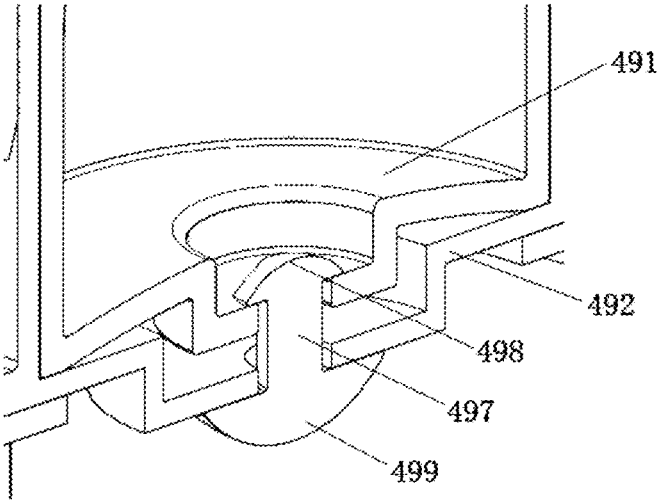
FIG. 16 is a schematic perspective view of an elastic supporting structure according to Embodiment 6 of the present disclosure.

As shown in FIG. 14, FIG. 15 and FIG. 16, the elastic supporting structure includes elastic piece 491, supporting piece 492, and valve trim 497. Moving clearance 493 is provided between the elastic piece 491 and the supporting piece 492. Recessed region 494 is provided at an axis of the elastic piece 491. The supporting piece 492 is provided with piston cavity 495 matching with a moving distance of the recessed region 494. Through holes 496 matching with each other are respectively formed in the recessed region 494 and the piston cavity 495. The valve trim 497 includes one end matching with the through hole 496 in the recessed region 494 through open valve cover 498, and the other end matching with the through hole 496 in the piston cavity 495 through sealed valve cover 499. With the open valve cover 498, the through hole 496 in the recessed region 494 is open in any state. In the non-use state, the elastic piece 491 pushes the roller ball 3 to be pressed toward the limit ring 43, such that the sealed valve cover 499 seals the through hole 496 in the piston cavity 495. In use, the roller ball 3 under a pressure pushes the valve trim 497 to move toward the bottle 1, such that both the through hole in the recessed region 494 and the through hole 496 in the piston cavity 495 are open.

In addition, in the embodiment, in order to detach the roller ball 3 for cleaning like Embodiment 4, and for ease of structure simplification and detachment, the elastic piece 491 and the supporting piece 492 are split. The supporting piece 492 and the connecting seat 41 are formed into a whole. The elastic piece 491 is located at a bottom of roller ball barrel 432. The roller ball barrel 432 is limited by fixed ring 431 formed with the connecting seat 41 into a whole. Meanwhile, the limit ring 43 includes the fixed ring 431 and the roller ball barrel 432. The fixed ring 431 is integrally formed with the supporting piece 492. The roller ball barrel 432 is integrally formed with the elastic piece 491.

The invention claimed is:

1. A roll-on packaging bottle, comprising an outer bottle, a cap, a roller ball, a connector, and an inner bottle, wherein both the outer bottle and the inner bottle are a container with an opening; the inner bottle is provided in the outer bottle; the connector is connected to the opening of the outer bottle and configured to fix the inner bottle; the roller ball is provided in the connector; an inner ring of the cap is provided with a limit member; the connector comprises a connecting seat and a limit ring; the limit ring is connected to the connecting seat to form a roller ball cavity; the connector is provided on the outer bottle through the connecting seat; the limit ring is a barrel coaxial with the connecting seat; a diameter of an inner cavity of the barrel matches with an outer diameter of the roller ball; and the roller ball is provided in the roller ball cavity;

a liquid outlet communicating with the inner bottle is formed in the connecting seat at a side of the roller ball cavity adjacent to the outer bottle; and a circle of annular profile attached to an outer surface of the roller ball is provided at an upper edge of the liquid outlet;

an opening of the limit ring at a side of the roller ball cavity away from the outer bottle is collapsed inward along the outer surface of the roller ball by a predetermined distance, wherein a diameter of the opening of the limit ring is slightly less than the outer diameter of the roller ball; and the limit ring is made of a material having predetermined elasticity; and in a non-use state, the cap covers the connector, the limit member is in interference fit with the limit ring, and sealing fit is formed at least between the roller ball and the limit ring, and between the roller ball and the annular profile.

2. The roll-on packaging bottle according to claim 1, wherein a knockout member is further provided on an inner wall of the cap; the knockout member is a cylindrical barrel; the cylindrical barrel is provided on the inner wall of the cap; and in the non-use state, a knockout portion of the knockout member directly or indirectly squeezes and fixes the roller ball, wherein the sealing fit is formed between the roller ball and the annular profile.

3. The roll-on packaging bottle according to claim 2, wherein the limit member is a cylindrical barrel; the cylindrical barrel is provided in the cap; and in the non-use state, the cylindrical barrel is in interference fit with an outer wall of the limit ring.

4. The roll-on packaging bottle according to claim 3, wherein the limit member and the cap are integrally formed into a whole.

5. The roll-on packaging bottle according to claim 3, wherein the cylindrical barrel is detachably provided on the knockout member.

6. The roll-on packaging bottle according to claim 5, wherein a bottom of a region of the cylindrical barrel matching with the outer wall of the limit ring extends horizontally outward and bends to form a supporting groove; and an outer wall of the supporting groove is attached to the inner wall of the cap.

7. The roll-on packaging bottle according to claim 5, wherein a side of the cylindrical barrel away from the outer bottle is provided with a knockout plate; a first movable receiving groove matching with the knockout member is formed in a top surface of the knockout plate; and in the non-use state, the knockout portion of the knockout member indirectly squeezes and fixes the roller ball through a bottom surface of the knockout plate.

8. The roll-on packaging bottle according to claim 5, wherein a squeezing member is detachably provided in the cap; a lower end surface of the squeezing member is a concave spherical surface matching with a profile of the outer surface of the roller ball; an insertion groove is formed in an upper end surface of the squeezing member; and in the non-use state, the knockout portion of the knockout member indirectly squeezes and fixes the roller ball through the concave spherical surface.

9. The roll-on packaging bottle according to claim 8, wherein a contact surface where a lower edge of the concave spherical surface contacts an upper edge of the limit ring is a truncated cone surface; and an aperture of a side of the truncated cone surface away from the outer bottle is greater than an aperture of a side of the truncated cone surface adjacent to the outer bottle.

10. The roll-on packaging bottle according to claim 1, wherein an elastic supporting structure is provided on the connecting seat; the limit member is a cylindrical barrel; the cylindrical barrel is provided in the cap; and in the non-use state, the elastic supporting structure pushes the roller ball to be pressed toward the limit ring, wherein the sealing fit is formed between the roller ball and the limit ring, and the cylindrical barrel is in interference fit with an outer wall of the limit ring.

11. The roll-on packaging bottle according to claim 10, wherein the elastic supporting structure comprises a plurality of fan-shaped elastic pieces; the plurality of fan-shaped elastic pieces are arranged on an inner ring of the liquid outlet in an annular array; a clearance is reserved between two adjacent ones of the plurality of fan-shaped elastic pieces; in the non-use state, the plurality of fan-shaped elastic pieces push the roller ball to be pressed toward the limit ring; and in use, the roller ball under a pressure pushes the plurality of fan-shaped elastic pieces to expand.

12. The roll-on packaging bottle according to claim 10, wherein the elastic supporting structure comprises a plurality of elastic restoration members arranged centrosymmetrically between the limit ring and the annular profile.

13. The roll-on packaging bottle according to claim 10, wherein the elastic supporting structure comprises an elastic piece, a supporting piece, and a valve trim;

a moving clearance is provided between the elastic piece and the supporting piece;

a recessed region is provided at an axis of the elastic piece;

the supporting piece is provided with a piston cavity matching with a moving distance of the recessed region;

through holes matching with each other are respectively formed in the recessed region and the piston cavity;

the valve trim comprises a first end matching with the through hole in the recessed region through an open valve cover, and a second end matching with the through hole in the piston cavity through a sealed valve cover;

in the non-use state, the elastic piece pushes the roller ball to be pressed toward the limit ring, wherein the sealed valve cover seals the through hole in the piston cavity; and in use, the roller ball under a pressure pushes the valve trim to move toward the outer bottle, wherein both the through hole in the recessed region and the through hole in the piston cavity are open.

14. The roll-on packaging bottle according to claim 11, wherein an upper edge of the limit ring is provided with a sealing ring; in the non-use state, the sealing ring contacts the roller ball in a sealing manner; and the sealing ring is made of a thermoplastic polyurethane (TPU) material.

15. The roll-on packaging bottle according to claim 12, wherein the limit ring comprises a fixed ring and a roller ball barrel; the fixed ring is integrally formed on the connecting seat; a second movable receiving groove matching with the fixed ring is formed in a bottom of the roller ball barrel; and an opening in a top of the roller ball barrel matches with the outer surface of the roller ball.

16. The roll-on packaging bottle according to claim 13, wherein the limit ring comprises a fixed ring and a roller ball barrel; the fixed ring is integrally formed with the supporting piece; and the roller ball barrel is integrally formed with the elastic piece.

17. The roll-on packaging bottle according to claim 6, wherein a side of the cylindrical barrel away from the outer bottle is provided with a knockout plate; a first movable receiving groove matching with the knockout member is formed in a top surface of the knockout plate; and in the non-use state, the knockout portion of the knockout member indirectly squeezes and fixes the roller ball through a bottom surface of the knockout plate.

18. The roll-on packaging bottle according to claim 6, wherein a squeezing member is detachably provided in the cap; a lower end surface of the squeezing member is a concave spherical surface matching with a profile of the outer surface of the roller ball; an insertion groove is formed in an upper end surface of the squeezing member; and in the non-use state, the knockout portion of the knockout member indirectly squeezes and fixes the roller ball through the concave spherical surface.

19. The roll-on packaging bottle according to claim 12, wherein an upper edge of the limit ring is provided with a sealing ring; in the non-use state, the sealing ring contacts the roller ball in a sealing manner; and the sealing ring is made of a thermoplastic polyurethane (TPU) material.

20. The roll-on packaging bottle according to claim 13, wherein an upper edge of the limit ring is provided with a sealing ring; in the non-use state, the sealing ring contacts the roller ball in a sealing manner; and the sealing ring is made of a thermoplastic polyurethane (TPU) material.

* * * * *